United States Patent [19]

Bartlett et al.

[11] Patent Number: 4,506,484

[45] Date of Patent: Mar. 26, 1985

[54] PANEL WALL SYSTEM

[75] Inventors: Gary F. Bartlett, Muncy, Pa.; Robert W. Olsen, New Providence, N.J.

[73] Assignee: Construction Specialties, Inc., Cranford, N.J.

[21] Appl. No.: 507,715

[22] Filed: Jun. 23, 1983

[51] Int. Cl.[3] ..... E04B 5/52

[52] U.S. Cl. ..... 52/476; 52/762; 52/768; 52/775; 52/489

[58] Field of Search ..... 52/476, 762, 768, 774, 52/775, 282, 489, 506, 509

[56] References Cited

U.S. PATENT DOCUMENTS

| | | | |
|---|---|---|---|
| 2,958,982 | 11/1960 | Baker | 52/775 X |
| 2,979,866 | 4/1961 | McLean | 52/775 |
| 3,008,249 | 11/1961 | Masters . | |
| 3,256,666 | 6/1966 | Farmer | 52/489 X |
| 3,391,512 | 7/1968 | Lopina | 52/768 |
| 4,470,231 | 9/1984 | Lewis | 52/768 X |

*Primary Examiner*—Carl D. Friedman
*Assistant Examiner*—Creighton Smith
*Attorney, Agent, or Firm*—Brumbaugh, Graves, Donohue & Raymond

[57] ABSTRACT

A panel wall assembly comprises rectangular pan-like panels mounted close together side by side and end to end. Retainers located at all junctures between the panels are fastened to the building structure, and the panels are fastened to the retainers by clips having arms that extend out through slots in the panel flanges. Troughs on each horizontal retainer drain condensate or water that leaks through seals between adjacent panels to drainage slots in the vertical retainers. Gaskets between the retainers and the panel flanges provide additional control of water flow behind the panel faces.

8 Claims, 5 Drawing Figures

PANEL WALL SYSTEM

FIELD OF THE INVENTION

The present invention relates to a panel wall system and, in particular, a wall cladding system that is especially suitable for use in commercial and industrial buildings.

BACKGROUND OF THE INVENTION

There are, of course, many ways of finishing the exteriors of commercial and industrial buildings. One type of external wall system utilizes individual prefabricated panels that are suitably fastened to the building framing, ordinarily by a relatively light-weight retaining system to which the panels can readily be attached and by which the panels are joined to the main building framing. Within this general type of exterior panel wall system are some commercially available versions that utilize composite panels composed of thin aluminum sheets laminated to a plastic core. These composite panels fit into a frame work made up of retainers having grooves that receive the edges of the panels.

These previously known panel systems based on aluminum/plastic/aluminum composite panels have several disadvantages. For one thing the framing system ordinarily requires that the panels and retainers be installed in step, panel by panel and retainer by retainer, working horizontally and vertically, inasmuch as the system depends upon reception of the panel edges in channels or tracks of the retainers. Thus, after a panel is installed, the retainer tracks for the then free edges of the panel are installed and so forth. As far as installation costs are concerned, the assembly procedure is relatively inexpensive and can be accomplished relatively quickly. On the other hand, there is a distinct disadvantage that any panels that might be damaged during the life of the building are difficult to replace. Moreover, the composite panels have shown a tendency to delaminate because of deterioration of the adhesives due to the effect of moisture that attacks the edges where they fit into the retainers.

An exterior building wall panel system should protect the building structure from intrusion of water but also allow the wall to breathe. These two desired characteristics conflict to some degree and are difficult to attain with relatively large panels, because thermal expansion and contraction of the panels is hard on any sealing system. It is quite possible that seals will leak, sometimes as a result of careless installation or, perhaps more commonly, as a result of wear and tear from hundreds or thousands of thermal cycles over a period of years. Water intrusion behind the panel faces due to condensation is inevitable under certain weather conditions.

An object of the present invention is to control the movement of water that gets behind the external face of a panel wall system, due to either leakage or condensation, so that it does not get into the building or, indeed, reach the insulation or the interior of the wall.

A further object is to control the movement of water in a manner such that it is drained back to the exterior skin of the panel system or to the ground.

Another object is to allow the space between the inner and outer skins of an exterior building wall finished with an impermeable exterior skin to breathe for equalization of air pressure across the "impermeable" skin.

SUMMARY OF THE INVENTION

The present invention provides for water control in an exterior panel wall system that comprises rectangular panels arranged close together side-by-side and end-to-end. The panels are joined to the main framing of the building by retainers, a vertical retainer being located at and being coextensive with the juncture between the vertical edges of each pair of adjacent panels and a horizontal retainer being located at and being coextensive with the juncture between the horizontal edges of each pair of adjacent panels. Each retainer is suitably fastened to the building structure. To the extent broadly described above, the system is known in the prior art.

The present invention, in particular, is an improvement in the system described and shown in U.S. patent application Ser. No. 458,540 of Jack Geortner, filed Jan. 17, 1983, for "Panel Wall Systems," which is assigned to the assignee of the present invention. The Geortner system comprises panels of pan-like shape mounted on the wall by a retainer system. Each panel consists of a principal wall forming a portion of the exterior building wall and a continuous peripheral flange extending inwardly toward the interior of the building from the principal wall, preferably perpendicularly to the principal wall. Each retainer includes a medial portion received between the flanges of the panels on either side of it and a lateral flange extending out on either side of the medial portion that provides a seating surface for the edge of the flange of the corresponding panel. The flange on each edge of each panel is fastened to the adjacent retainer by attachment clips that are connected to the medial portion of the retainer by screws and have arms that extend through slots in the panel flange. In a preferred embodiment the slots in the adjacent flanges of each pair of adjacent panels are located opposite each other and each attachment clip has an arm at each end that extends into the corresponding slot. Hence, each clip joins the adjacent flanges of adjacent panels to the retainer between them.

The present invention is characterized in that each horizontal retainer has a longitudinally continuous drainage trough located within the space bounded by the flange of the corresponding panel to receive water from that space that might otherwise leak further toward the building structure and in that each vertical retainer has a longitudinally continuous drainage slot serving the drainage trough of each adjacent horizontal retainer, each trough opening to the drainage slot of the adjacent vertical retainer.

In a preferred embodiment, the present invention is further characterized by one or more of the following features:

1. Each drainage trough is constituted by a portion of the horizontal retainer that is generally U-shaped in cross section, joins the flange portion outwardly of the seating surface, with respect to the web portion, and opens toward the principal surface of the panel.

2. Each drainage slot is defined by a second flange portion that joins the web portion of the vertical retainer and lies in spaced relation to the rear of the seating flange portion, with respect to the panel, whereby the drainage slot is defined by the seating flange portion, a part of the web portion and the second flange portion.

3. There is a gasket on each seating surface, the gasket being of a low friction material so as not to inhibit substantially movement of the edges of the panel flanges due to thermal expansion and contraction and each gasket including a portion of generally V-shaped cross section lying flatwise on the seating surface of the seating flange. The V-shaped portion is resilient and has a leg portion that is resiliently urged generally flatwise into engagement with the edge of the flange of the corresponding panel.

4. Each gasket on each horizontal retainer is oriented with the opening of the "V" facing upwardly so that it functions like a trough and can carry water toward an adjacent vertical retainer.

5. Each gasket on each vertical retainer is oriented with the opening of the "V" facing inwardly with respect to the web portion so that it tends to direct water toward the vertical junctures between adjacent panels and exclude water from the areas behind the panels.

6. The lower end of an array of panels is finished with flashing behind and under the lower portion of each bottom panel, the bottom flange of each bottom panel being spaced-apart from the flashing to allow drainage of water and the lower end of each vertical retainer opening to the flashing to discharge water from the drainage slots to the flashing. In addition, the open slot between the bottom panels of the array and the flashing allows air to enter behind the sealed face of the panel array and permits equalization of the air pressure between the exterior sealed face and the spaces between the sealed face and an interior airtight barrier.

7. The bottom flange of each bottom panel is secured to the building structure against downward movement by clips so that the spacing between it and the flashing is maintained.

A panel wall system constructed in accordance with the present invention has several advantages over prior art systems. It utilizes durable panels that are highly resistant to damage due to deterioration from sun, dirt, moisture, thermal cycling, fire, and other environmental conditions and hazards. The panel edges are protected from the weather by a sealant or gasket. The system provides for relative movement due to differences in thermal expansion and contraction of the panels, retainers and the building structure, respectively. In the event that a panel is damaged it can be easily removed and replaced. The system is architecturally distinctive in that it is based on relatively massive panels separated only by very thin lines and entirely free of any visible framing or other supporting elements. Water that gets behind the external skin due to leakage and condensation is controlled and ultimately drained back out to the bottom of the wall or wall section. Air is admitted behind the panel system and can flow readily through the drainage slots and troughs of the retainers and over all of the internal surfaces of the system behind the impermeable external skin for pressure equalization, which itself greatly reduces the possibility of water leakage due to wind pressure.

For a better understanding of the invention reference may be made to the following description of an exemplary embodiment, taken in conjunction with the figures of the accompanying drawings.

DESCRIPTION OF AN EXEMPLARY EMBODIMENT

Figure 1:
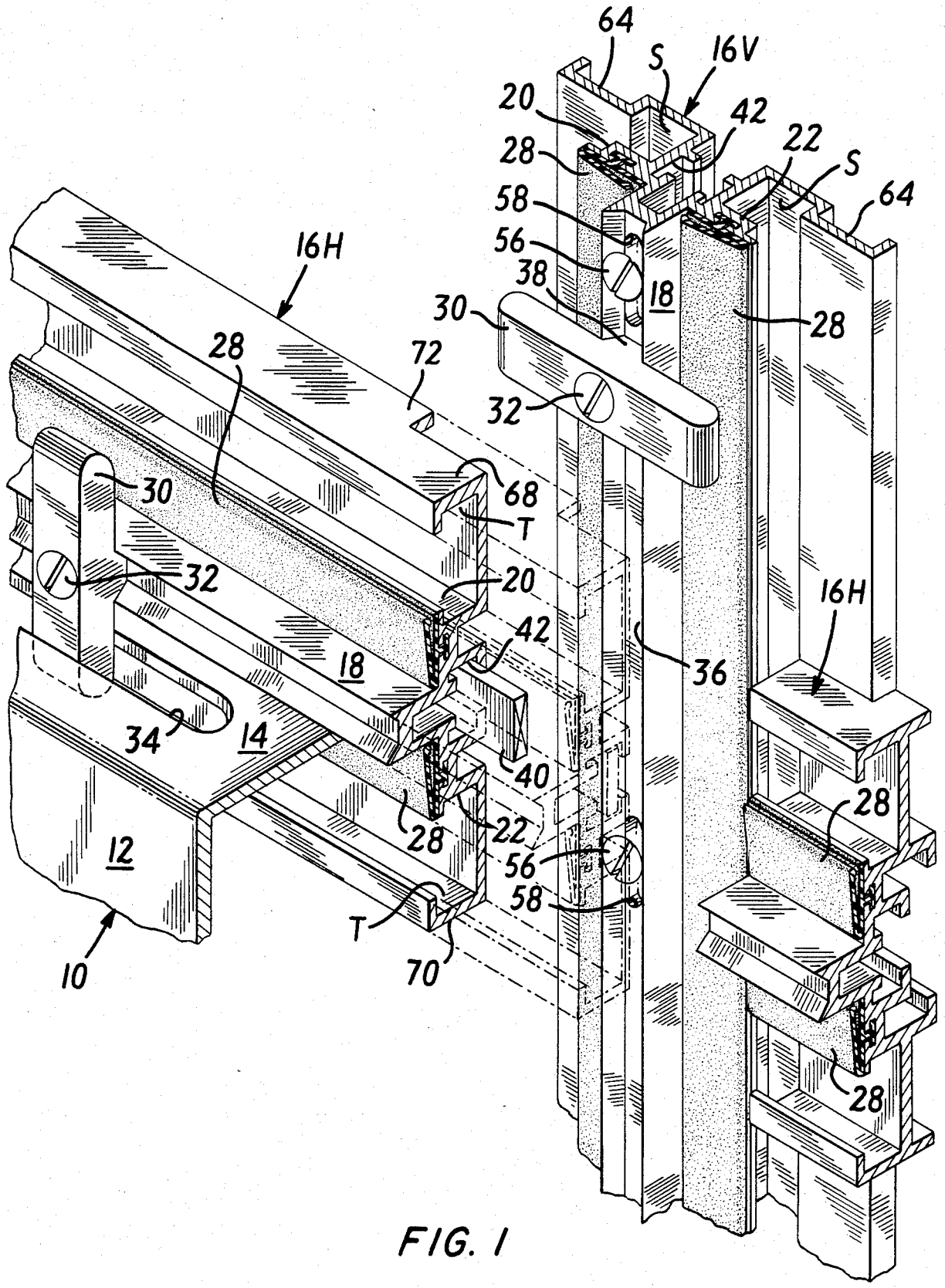
FIG. 1 is a perspective view from in front, above and to one side, and with portions broken away, of a typical juncture between vertical and horizontal retainers in a system according to the present invention.
Figure 2:
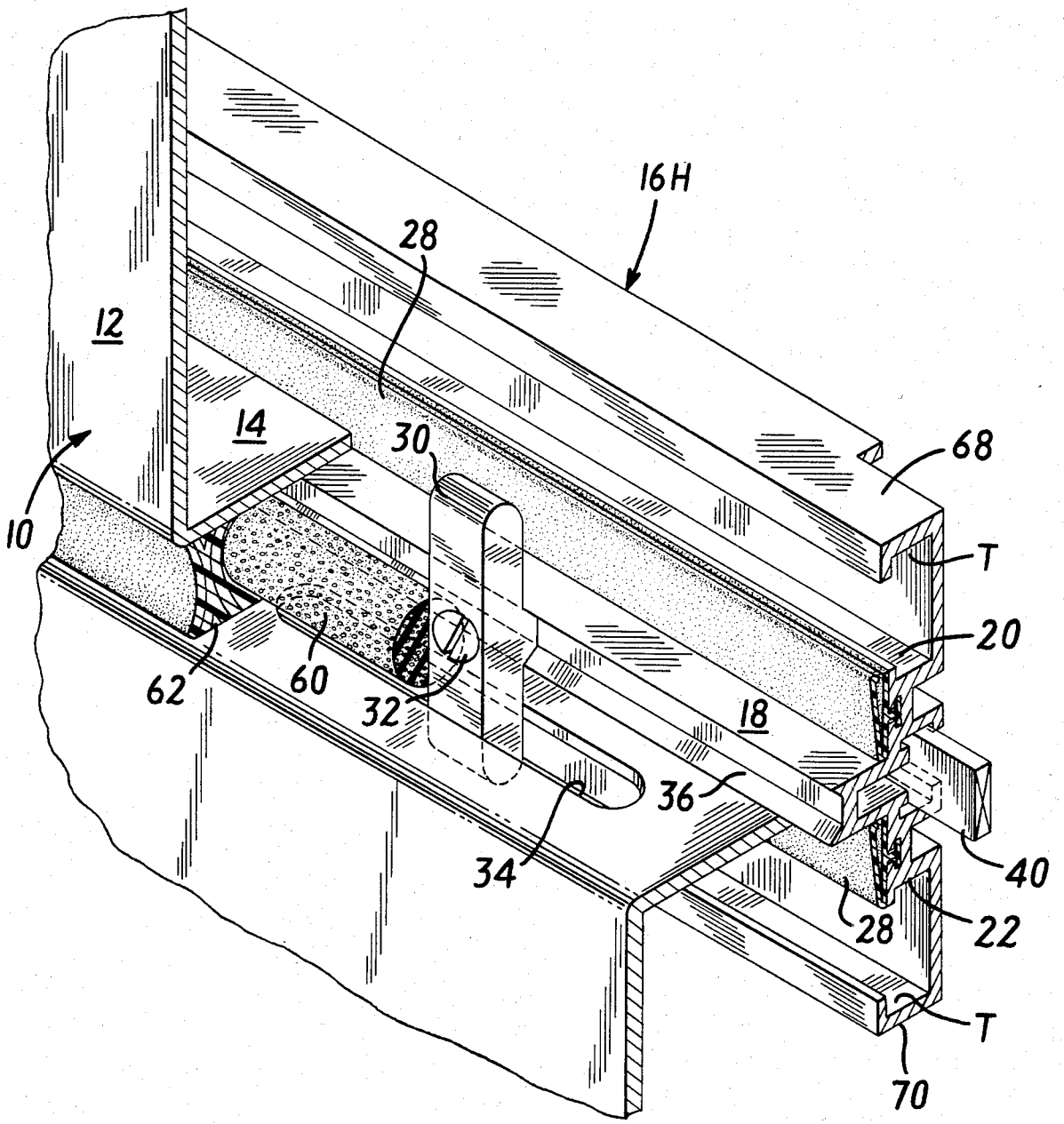
FIG. 2 is a perspective view from in front, above and to one side and with portions broken away to show clearly how the panels are joined to the retainers and how the joints between panels are sealed.

The present invention is a panel wall cladding system based on a multiplicity of rectangular panels 10 arranged in closely spaced relation side by side and end to end. In a preferred embodiment the panels 10 are all of the same size and are arranged with the adjacent corners of each cluster of four panels meeting at a common point. This is the preferred arrangement for aesthetic and structural reasons, but it is also possible to stagger the panels in other arrangements. Ordinarily, the panels should be aligned vertically for structural reasons, but the positions of individual panels in adjacent vertical rows can be varied. Moreover, an installation can employ panels of different sizes. Panels located at a corner of the building can extend around the corner and may have rounded or sharp corners.

Each panel 10 is generally pan-shaped in that it is composed of a principal wall portion 12 that forms the exterior wall surface and an inturned peripheral flange 14 that is of uniform width, extends entirely around the perimeter of the panel and extends in toward the building structure, preferably perpendicular to the principal wall portion 12. In the illustrated embodiment each panel 10 is made from aluminum sheet 0.120 inch in thickness formed so that the flanges are integral with the principal wall. Square segments are cut from each corner of the panel before it is formed, and the edges of the vertical and horizontal segments of the peripheral flange are joined at the corners by welding. The welds are ground and polished to provide smooth and rounded edges for good appearance. The panels are treated for corrosion resistance and may be finished with any suitable quality architectural finishes, such as anodic coatings or fluorocarbon paints. The panels may range in size from about $2' \times 2'$ to about $5' \times 5'$. Stiffeners should be added in large size panels. The stiffeners may, for example, be $4'' \times 1\frac{3}{8}''$ deep hat-shaped sections mechanically fastened or bonded by an epoxy adhesive to the principal wall and secured to the flanges.

The panels may be made from materials other than aluminum sheet. For example, the panels may be aluminum-polymeric foam-aluminum sandwiches, molded fiberglass or vacuum-formed vinyl-acrylic. Soldering, brazing or adhesive-joining can be substituted for welding. Special panel shapes (not shown) will be provided at corners and for copings, soffits and other architectural details.

The panels are joined to the building by a system of retainers, there being a vertical retainer 16V located at the vertical juncture between each pair of side by side panels and a horizontal retainer 16H located at the juncture between each pair of vertically adjacent panels.

The respective retainers 16V and 16H are each of uniform cross section along their length and are, preferably, extruded from aluminum. The center, front portions of both retainers 16V and 16H are of identical cross-sectional shape, consisting of a U-shaped web portion 18 and a pair of lateral flanges 20 and 22 that extend out on either side of the web portion. The front faces 24 and 26 of the flanges 20 and 22 constitute seating surfaces for the edges of the panel flange 14. A longitudinally continuous gasket 28 of a low friction material is received on the front face of each flange 20 and 22 and facilitates movement of the edges of the panel flanges toward and away from the medial flange 18, due to differential thermal expansion and contraction. In the exemplary embodiment shown in the drawings, the gasket 28 on each of the flanges 20 and 22 of all of the retainers are made of semi-rigid polypropylene and in cross section comprise a T-shaped mounting portion 28*a* and a V-shaped sealing portion 28*b*. As initially formed, the legs of the V are considerably more divergent than in the installed condition shown in the drawings, the outer sealing leg being resiliently deformed upon installation of the panels by engagement with the end of the corresponding panel flange 14. The resiliency of the gaskets maintains the front sealing leg in good sealing engagement with the flange edge.

The panels are connected to the adjacent retainers along all four sides by attachment clips 30 that are fastened to the U-shaped web portion 18 of the retainer by self-drilling/self-tapping screws 32. Each clip 30 has arms extending outwardly in either direction from the web portion of the retainer and out through slots 34 in the flanges of the panels. Depending upon the size of the panel and other design considerations, the spacing of the clips may range from about 12" to 24" along each flange. A groove 36 extends along the entire length of the front of the web portion of the retainer, the side walls of the groove 36 being tapered in correspondence with the taper of flat head screws. Each clip has a rib 38 having tapered walls that match the taper of the groove 36. The groove 36 serves as a key-way for all of the clips, and the rib 38 serves as a key that ensures proper positioning of the clips with their lengthwise axes lying perpendicular to the lengthwise axis of the retainer.

The width of each slot 34 in the flanges of the panels is slightly greater than the overall thickness of the clip (the thickness being considered as the dimension perpendicular to the principal faces of the panels) so that each clip can be initially oriented perpendicular to its installed position, slipped in between adjacent panels, rotated to the installed position and fastened to the retainer. To this end, the slots 34 are also elongated in a direction parallel to the edge of the panel (see FIG. 3) to permit the clips to be rotated into and out of the slots.

The dimension "X" (see FIG. 4) between the end of each panel flange 14 and the inner edge of the slot 34 engaged by the corresponding arm of the clip 30 is somewhat less, say 1/32 inch, than the distance between the aforementioned edge of the slot and the front faces 24 and 26, respectively, of the retainers, thereby leaving a clearance that ensures that the ends of the panel flanges are not tightly clamped against the surfaces 24 and 26. Accordingly, the ends of the panel flanges can slide on the seals to accommodate thermal expansion and contraction.

Each vertical retainer 16V (see FIG. 4) has a rear flange portion 64 along either side, a part 66 of which defines with one of the respective seating flanges 20 or 22 a drainage slot S. Each horizontal retainer 16H (see FIG. 5) has an upper flange 68 and lower flange 70 of generally T-shape that forms a drainage trough T. The drainage slots S extend continuously along the length of each vertical retainer and, similarly, the drainage troughs T extend continuously along the length of each horizontal retainer. Longitudinally continuous ribs 72 and 74 extend along the back of each horizontal retainer and bear against the building structure.

Each horizontal retainer 16H is joined at each end to the adjacent vertical retainers 16V by a splice bar 40 that is received in a channel-shaped socket 42 in the back (see FIG. 1) of the medial portion of the retainer. Portions of outer face of each splice bar bear against a pair of ribs 44, and the edge portions of the inner face bear against ribs 46. The splice bar is retained in place in each horizontal retainer 16H by deforming portions of the ribs 46 into notches (not shown) in the inner face of the splice bar. The end of the splice bar extends out beyond the end of the horizontal retainer and the front face of that end bears against the back face of the flange portion 20 and 22 of the vertical retainer 16V. Portions of the ribs 72 and 74 on the backs of the horizontal retainers 16H are cut away (see FIG. 1) to allow the vestigial portions of the ends of the horizontal retainers to overlap the back flanges 64 of the vertical retainers. Thus, the ends of the drainage troughs T communicate with the drainage slots S of the vertical retainer.

Each vertical retainer preferably runs continuously as a single section or two or more spliced sections (using splice bars) throughout the vertical extent of an array of panels and is fastened at suitable intervals to the building structure by a suitable fastening system. In the embodiment shown in the drawings, the structure of the building itself includes steel studs 54 welded or otherwise mechanically fastened between the main frame beams or other elements at the perimeter. Each vertical retainer is fastened to the steel studs 54 by self-drilling-/self-tapping screws 56 that pass through elongated slots 58 in the medial portion 18 of the retainer, through shims 59 (if required), through sheathing (if provided) and through the outer flange of the stud 54. The elongated slots 58 allow for the difference between the thermal expansion and contraction of the aluminum retainer and the thermal expansion had contraction of the building structure. The flange 64 at each edge at the back of the retainer can be used for fastening the retainer to a block, concrete or other solid building wall.

After installation of the panel system backer rods 60 of a moderately compressible polymeric foam are installed at all joints between the panels, and the joints are sealed and finished with a suitable elastomeric sealant 62. The sealant not only seals the wall but protects the panel edges from moisture, an important advantage in the case of composite panels. Moderately compressible neoprene or EPDM rubber gaskets or other suitable dry joint systems can be substituted for the backer rods and sealant.

At the top edge of an array of panels a top retainer (not shown) is used to join the upper flanges of the upper panels to the building. The top retainer is nearly exactly like the horizontal retainer shown in FIG. 5, except that the "T" section 68 that forms the upper trough is omitted, thus terminating the upper part with the upper rib 74.

Figure 4:
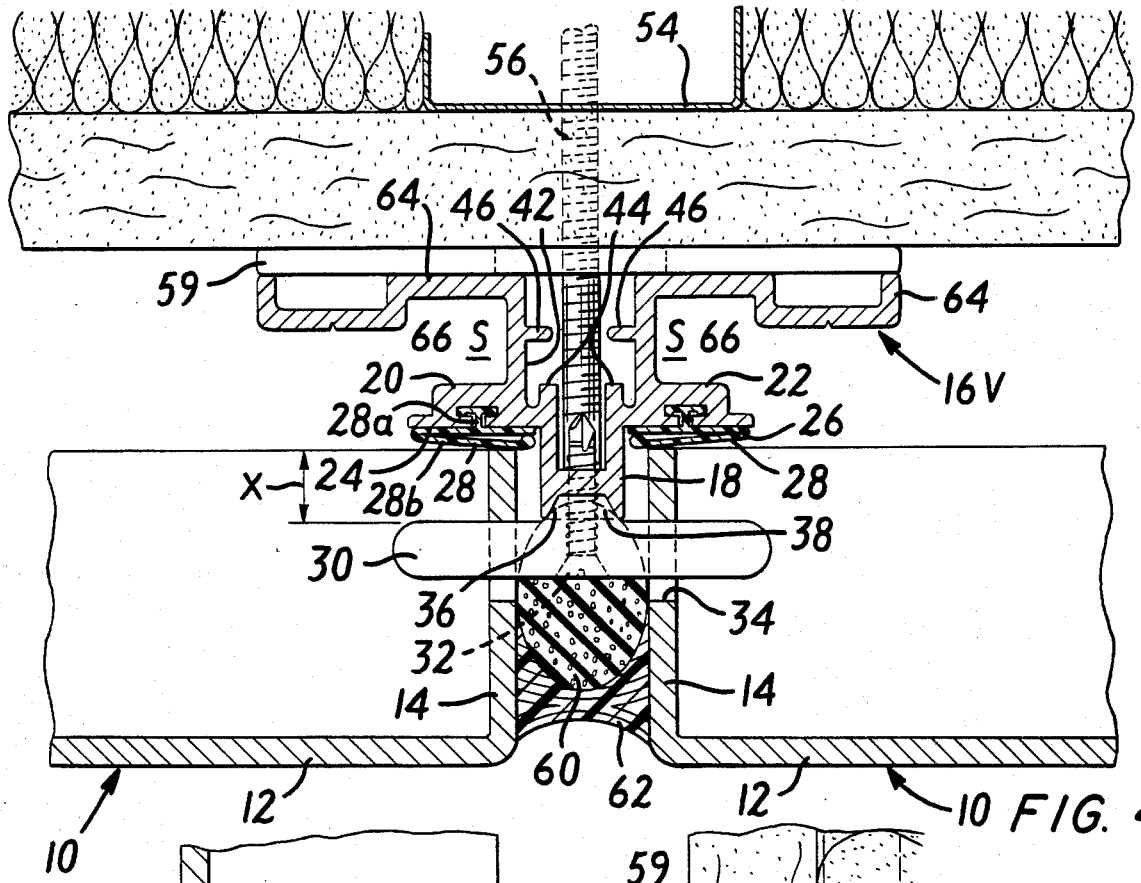
FIG. 4 is a fragmentary top cross-sectional view taken at the vertical juncture between side-by-side panels.
Figure 5:
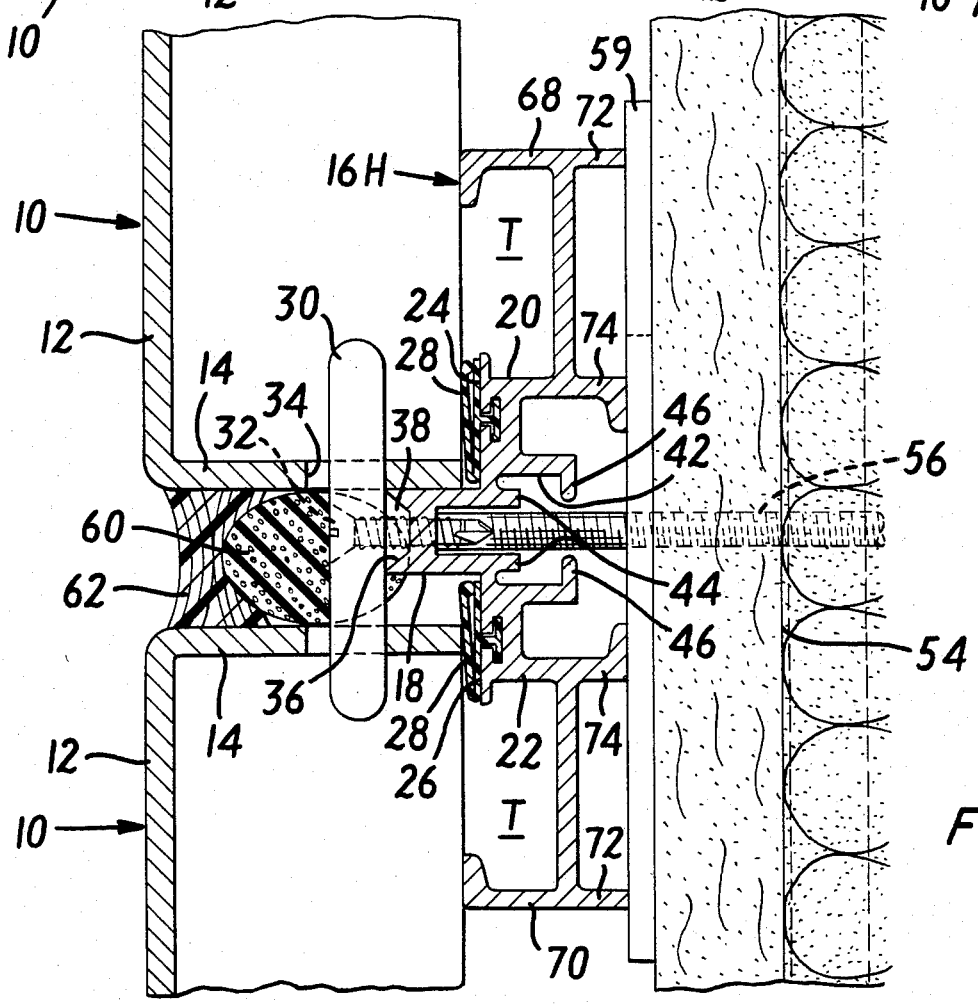
FIG. 5 is a fragmentary side cross-sectional view taken at the horizontal juncture between vertically adjacent panels.

Each vertical edge of an array of panels (e.g., at a window mullion or an adjacent wall section of masonry or some other material) is terminated by a side retainer (not shown) that is the same as the vertical retainer of FIG. 4, except that one rear flange 64 and one seating flange 24 or 26 is omitted.

In both top and side terminations of panel arrays, "half clips" (not shown, but the same as the full clips except that one arm is omitted) fasten the corresponding panel flange 14 to the retainer.

Figure 3:
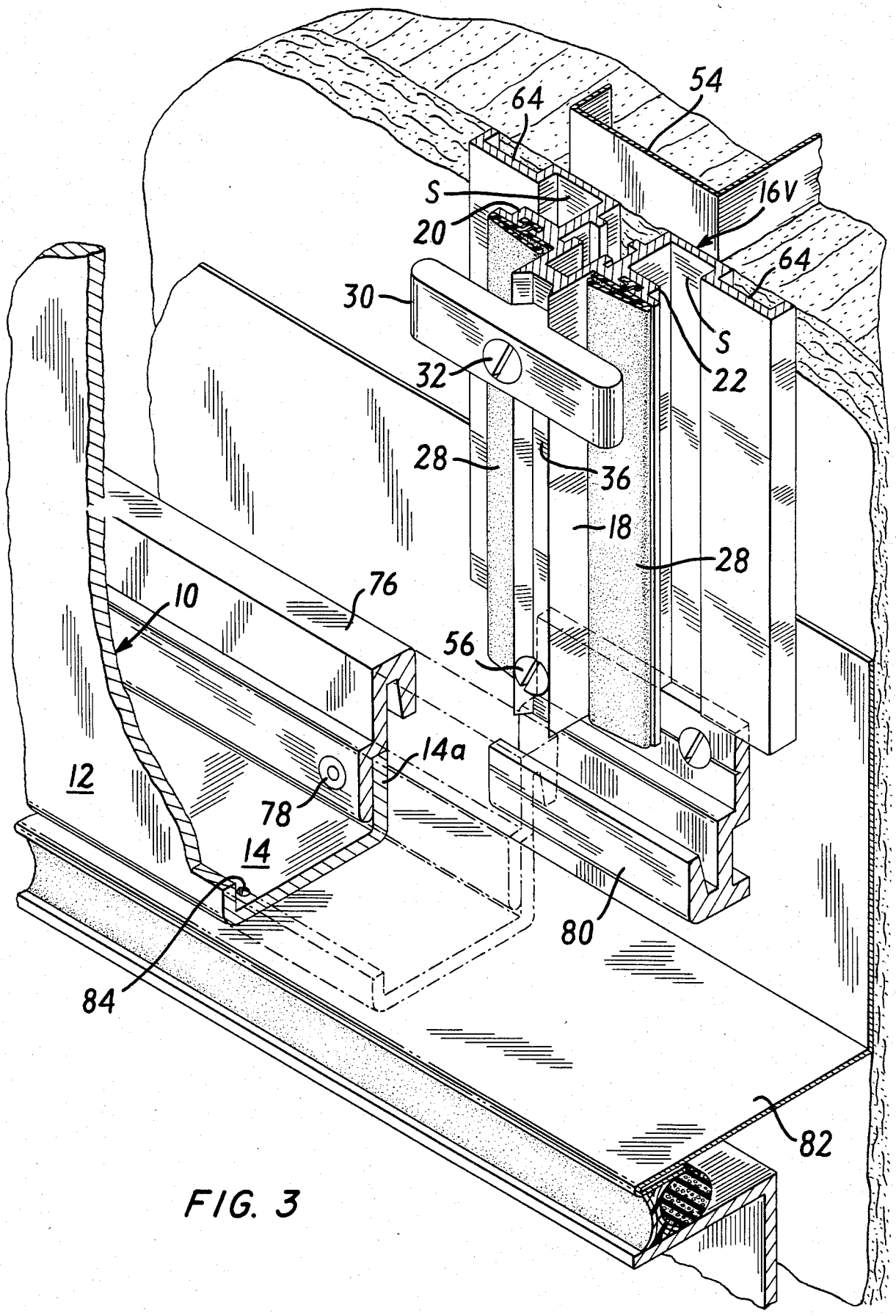
FIG. 3 is a perspective view from in front, above and to one side of the system and with portions broken away to show clearly how the bottom panels of a typical wall or section of a wall are joined to the retaining system and how water is drained from the bottom and ventilation air is admitted behind the front impermeable skin.

Referring to FIG. 3, the bottom termination of an array of adjacent panels making up a wall or wall section (e.g., above a window or at the bottom of the wall) uses special panels having an upturned rib 14*a* along the back end of the bottom panel flange 14. A bracket 76 is fastened to the rib by rivets 78. The bracket fits into clips 80 that are fastened at suitable intervals (e.g., 24") to the building structure. The clips and brackets, in effect, hang the lower panels from below so they cannot move or expand downwardly.

Each bottom termination includes flashing 82 extending some distance up the wall behind the panel system and horizontally along the top of the mullion, a foundation or other horizontal element below the panel wall. A gap is left between the horizontal flashing and the bottom flanges of the lowermost panels so that air can enter and then flow up behind the panel array for pressure equalization.

As mentioned above, each vertical retainer is fastened to the building structure in a way that permits it to expand and contract relative to the structure. Each horizontal retainer is usually securely fastened to the building structure so that it can support the panel above it (see the upper panel in FIG. 5). The horizontal retainers are spliced, but not fastened, to the vertical retainers so that vertical expansion and contraction of the vertical retainers is not inhibited by the horizontal retainers. Because of the clearance between the ends of the panel flanges 14 and the seating surfaces 24 and 26 of the retainers, each panel 10 can expand and contract both vertically and horizontally relative to the retainer system. The vertical expansion and contraction ordinarily occurs only at the upper horizontal retainer, the bottom flange of the panel remaining stationary.

The water control system provided in the panel assembly, in accordance with the present invention, ultimately directs water that is formed by condensation or leaks into the space between the impermeable outer skin (the panel faces 12 and seals 62) and the sheathing (or some other internal wall material behind the panels) toward the vertical drain slots S and the vertical spaces located between the side flanges of adjacent panels. The way in which water is handled by the invention depends upon several variable factors, such as where the water is, how much there is, the magnitude of the air pressure differential, if any, at a breakthrough in the sealing system, the effectiveness of the gaskets 28 at any particular location or locations and the way in which the backer rod is installed in a particular installation. On this last point, in most cases the backer rod 60 will be notched in the back wherever it crosses over a clip 30 so that the sealant 62 can be applied evenly for good appearance and effectiveness of the seal. Depending upon the workmanship, particularly the notching of the backer rod, the slots 34 in the panel flanges (for the clips 30) will be partially or fully blocked by portions of the backer rod where they fit around the clips 30. If these slots are not closed up entirely, some water will pass vertically from panel to panel through the slots in the horizontal flanges and ultimately reach the lowermost panels of an array. Thus, the bottom panels have weep holes 84 to release the water to the flashing 82.

Most condensation that occurs within the panel system occurs on the internal surfaces of the panels. Condensate droplets will run to the bottom flange. Some of the condensate can run from the bottom flange through the slots 34, perhaps running down from panel to panel to the bottom. It is also probable that there will be points along the horizontal gasket 28 where leakage occurs, and some water may drain by leaking past the gaskets down to the top flange of the next panel. A gap is intentionally left between each end of each horizontal gasket and the adjacent vertical gasket. Water will drain through this gap and start to flow down the edge and back of the seating flange. Water tends to cling and spread out in flowing along a surface, so that water drained through the gaps in the gaskets will reach and run down the drainage slots S of the vertical retainers.

Water on the top of a panel that is blocked by the backer rod will tend to flow along the upper surface of the upper flange and be released through the gaps at either end of the upper horizontal gasket and will flow down the vertical retainer. Any water that leaks past the horizontal gasket from the top flange will drop into the lower trough T, from which it will drain at either end into the vertical drainage slots S of the adjacent vertical retainers.

The system of the present invention readily handles condensate, inasmuch as the amount of water involved in any given period of time is small. If condensate cannot find its way down a vertical array of panels through the slots 34 for the clips, the various horizontal gaskets it encounters will progressively direct more and more of the water to the drainage slots S.

Leakage due to break-throughs of the seals between the panels will usually be accompanied by forceful intrusion of water due to wind pressure against the wall. If the break-through is in a vertical seal between panels, some or all of the water will flow down the external faces of the vertical flanges of the panels and in front of the retainer on either side of the web portion 18 and ultimately reach the bottom of the wall or wall section. If the clip slots in the vertical flanges of the panels are open, some water may pass through them and drain from the panels in the same manner as condensate is drained, as described above. Any leakage past a vertical gasket will tend to flow along the surfaces of the vertical retainer and eventually migrate to the rear drainage slots as the flow spreads.

Water blown in or seeping through a break-through in a horizontal seal will tend to reach the upper surface of the upper flange of the panel below that seal and drain through any openings in the clip slots 34, leak past the horizontal gasket for that flange, drain through the gaps between the horizontal gaskets and the adjacent vertical gaskets, and drip or flow from panel to panel. Again, the succession of horizontal gaskets that the water encounters controls the flow and directs it toward the vertical retainers where it can readily flow down to the bottom of the wall.

At the bottom of the drainage slots and, for that matter, at the lower end of the entire panel assembly all water coming down flows onto the flashing and is discharged back to the exterior of the building. If desired, a gutter could be provided along the lower termination of a wall section for additional control of where the water is ultimately discharged.

In addition to serving as a means of controlling the flow of water, the drainage system also enhances breathing of the interior space in the wall between the impermeable outer surface and an essentially impermeable internal surface, such as aluminum facing on the insulation. Air can enter freely through the gap between the flashing 82 and the bottom flanges of the bottom panels. Although the grid of retainers may somewhat obstruct air flow behind the panels, depending on the shimming and what standoff there may be between the retainers and the wall, air can readily flow up the drainage slots S and out through the drainage troughs T in the horizontal retainers for enhanced ventilation and pressure equalization. In this respect the invention is a novel application of the curtain wall design principle that has been termed "rain screen" and is known per se. According to this principle a curtain wall is provided with openings for admitting air into a space behind the "rain screen," the impermeable face, which in this case is composed of an array of panel faces sealed by a sealant on a gasket system. A reasonably air-tight interior barrier allows for a pressure differential between the interior of the building and the air space behind the panel faces. The resulting build-up in pressure in the space between the rain screen and the interior barrier greatly reduces the tendency for water leakage through the rain screen by being blown in. The vertical heights of groups or arrays of panels can be such as to permit pressure equalization to take place fairly rapidly, so that any leakage caused by intermittent increases in external pressure (wind gusts) is minimized. Any water that does leak through the rain screen is controlled and removed from the spaces by the drainage system, as described above.

We claim:

1. An exterior panel wall assembly having a multiplicity of rectangular pan-like panels arranged in closely spaced-apart relation side by side and end to end, each panel having a principal wall forming a portion of an exterior building wall and a continuous peripheral flange extending inwardly from the principal wall toward the building structure, an elongated vertical retainer joined to building structure and located at and coextensive with each vertical flange of each panel and an elongated horizontal retainer joined to the building structure and located at and coextensive with each horizontal flange of each panel, each retainer having a web portion that at least partly overlaps a portion of the flange of each panel adjacent to it and a lateral seating flange portion extending outwardly from the web portion, underlying the edge of the flange of the panel adjacent to it and constituting a seating surface for that flange edge, and attachment clips fastened to the web portions of the retainers, each clip having an arm extending outwardly through a slot in the flange of the adjacent panel, characterized in that each horizontal retainer has a longitudinally continuous drainage trough located within the space bounded by the flange of the corresponding panel to receive water that might otherwise collect in said space or leak toward the building structure, and each vertical retainer has a longitudinally continuous drainage slot serving the drainage trough of each adjacent horizontal retainer, each trough opening to the drainage slot of the adjacent vertical retainer.

2. A panel assembly according to claim 1 and further characterized in that each drainage trough is constituted by a portion of the horizontal retainer that is generally U-shaped in cross section, joins the flange portion outwardly of the seating surface, with respect to the web portion, and opens toward the principal surface of the panel.

3. A panel assembly according to claim 1 and further characterized in that each drainage slot is defined by a second flange portion that joins the web portion of the vertical retainer and lies in spaced relation to the rear of the seating flange portion, with respect to the panel, whereby the drainage slot is defined by the seating flange portion, a part of the web portion and the second flange portion.

4. A panel assembly according to claim 1 and further having a gasket on each seating surface, the gasket being of a low friction material so as not to inhibit substantially movement of the edges of the panel flanges due to thermal expansion and contraction and characterized in that each gasket includes a portion of generally V-shaped cross section lying flatwise on the seating surface of the seating flange, at least the V-shaped portion being resilient and having a leg portion resiliently urged generally flatwise into engagement with the edge of the flange of the corresponding panel.

5. A panel assembly according to claim 4 and further characterized in that each gasket on each horizontal retainer is oriented with the opening of the "V" facing upwardly so that it tends to catch and direct water toward an adjacent vertical retainer.

6. A panel assembly according to claim 4 and further characterized in that each gasket on each vertical retainer is oriented with the opening of the "V" facing inwardly with respect to the web portion so that it tends to retain water in the vertical space at the vertical junctures between adjacent panels.

7. A panel assembly according to claim 1 and further characterized in that the lower end of an array of panels is finished with flashing behind and under the lower portion of each bottom panel, the bottom flange of each bottom panel being spaced-apart from the flashing to allow entry of air for pressure equalization between the exterior and the interior of the panel principal walls and to allow drainage of water, and the lower end of each vertical retainer opening to the flashing to discharge water onto the flashing.

8. A panel assembly according to claim 7 and further characterized in that the bottom flange of each bottom panel is secured to the building structure against downward movement by clips so that the spacing between it and the flashing is maintained.

* * * * *